US010247131B2

(12) United States Patent
Kawakami et al.

(10) Patent No.: US 10,247,131 B2
(45) Date of Patent: Apr. 2, 2019

(54) CYLINDER HEAD OF ENGINE

(71) Applicant: MITSUBISHI JIDOSHA KOGYO KABUSHIKI KAISHA, Tokyo (JP)

(72) Inventors: Nobuhiro Kawakami, Tokyo (JP); Hayato Sugimura, Tokyo (JP); Toshihiko Oka, Tokyo (JP); Masahiko Kubo, Tokyo (JP); Kazuki Yagi, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 12 days.

(21) Appl. No.: 15/039,576

(22) PCT Filed: Dec. 1, 2014

(86) PCT No.: PCT/JP2014/081702
§ 371 (c)(1),
(2) Date: May 26, 2016

(87) PCT Pub. No.: WO2015/087728
PCT Pub. Date: Jun. 18, 2015

(65) Prior Publication Data

US 2017/0175669 A1 Jun. 22, 2017

(30) Foreign Application Priority Data

Dec. 9, 2013 (JP) ..... 2013-254104
Dec. 18, 2013 (JP) ..... 2013-261719

(51) Int. Cl.
*F02F 1/14* (2006.01)
*F02F 1/40* (2006.01)
(Continued)

(52) U.S. Cl.
CPC *F02F 1/40* (2013.01); *F01P 3/02* (2013.01); *F02F 1/243* (2013.01); *F02F 1/4264* (2013.01); *F01P 2003/024* (2013.01)

(58) Field of Classification Search
CPC ..... F02F 1/40; F02F 1/243; F02F 1/14
(Continued)

(56) References Cited

U.S. PATENT DOCUMENTS 7,784,442 B2 * 8/2010 Lester ..... F01N 3/046 123/193.5
7,980,206 B2 * 7/2011 Nagafuchi ..... F02F 1/243 123/193.5
(Continued)

FOREIGN PATENT DOCUMENTS

CN 101440755 A 5/2009
CN 202381182 U 8/2012
(Continued)

OTHER PUBLICATIONS

Office Action dated May 16, 2017 in counterpart Japanese Application No. 2013-254104 with an English Translation.
(Continued)

*Primary Examiner* — Marguerite J McMahon
*Assistant Examiner* — James J Kim
(74) *Attorney, Agent, or Firm* — Birch, Stewart, Kolasch & Birch, LLP

(57) ABSTRACT

In a cylinder head (1) having a built-in exhaust manifold (6) of an engine (10), outer coolant passages (23A and 23B) in which an engine coolant circulates are provided, and are disposed along the manifold positioned at a side of an outer surface (14C) of the cylinder head (1). Further, inner coolant passages (24A and 24B) having shapes which are branched from the outer coolant passages (23A and 23B) and then join are provided, and are disposed along the outer coolant
(Continued)

passages (23A and 23B) and at an inner side of the cylinder head (1).

11 Claims, 6 Drawing Sheets

(51) Int. Cl.
*F02F 1/24* (2006.01)
*F01P 3/02* (2006.01)
*F02F 1/42* (2006.01)

(58) Field of Classification Search
USPC .... 123/41.72, 41.79, 41.82 R, 568.13, 41.74
See application file for complete search history.

(56) References Cited

U.S. PATENT DOCUMENTS

| | | | | |
|---|---|---|---|---|
| 8,839,759 | B2 | 9/2014 | Riegger et al. | |
| 8,931,441 | B2 | 1/2015 | Beyer et al. | |
| 9,470,178 | B2 | 10/2016 | Beyer et al. | |
| 9,562,493 | B2 * | 2/2017 | Wakiya | F02F 1/243 |
| 2007/0215074 | A1 * | 9/2007 | Rozario | F02F 1/4264 123/41.82 R |
| 2008/0308050 | A1 * | 12/2008 | Kuhlbach | F02F 1/243 123/41.82 R |
| 2009/0126659 | A1 | 5/2009 | Lester et al. | |
| 2012/0012073 | A1 * | 1/2012 | Brewer | F01N 13/105 123/41.74 |
| 2012/0037101 | A1 * | 2/2012 | Riegger | F02F 1/4264 123/41.82 R |
| 2013/0239915 | A1 | 9/2013 | Beyer et al. | |
| 2015/0090203 | A1 | 4/2015 | Beyer et al. | |
| 2016/0363096 | A1 | 12/2016 | Beyer et al. | |

FOREIGN PATENT DOCUMENTS

| | | | |
|---|---|---|---|
| JP | 60-108715 | U | 7/1985 |
| JP | 61-104148 | A | 5/1986 |
| JP | 7-317597 | A | 12/1995 |
| JP | 2008-75508 | A | 4/2008 |
| JP | 4098712 | B2 | 6/2008 |
| JP | 2009-115031 | A | 5/2009 |
| JP | 4262343 | B2 | 5/2009 |
| JP | 2010-275915 | A | 12/2010 |
| JP | 2012-177342 | A | 9/2012 |

OTHER PUBLICATIONS

Extended European Search Report issued in the corresponding European Patent Application No. 14869660.2, dated Jul. 20, 2017.
Office Action dated Jul. 11, 2017 in counterpart Japanese Application No. 2013-261719 with an English Translation.

* cited by examiner

CYLINDER HEAD OF ENGINE

TECHNICAL FIELD

The present invention relates to a cylinder head which has a built-in exhaust manifold of an engine.

BACKGROUND ART

Conventionally, an engine having an exhaust manifold built in a cylinder head has been developed. That is, the cylinder head and the exhaust manifold are integrally formed such that a plurality of exhaust ports continuing to a combustion chamber of the engine joins in the cylinder head. This structure can reduce a distance between an exhaust gas purifying catalyst interposed in an exhaust system and an engine, and improve exhaust purification performance. Further, a length of the exhaust system is reduced, so that it is possible to reduce pressure loss due to exhaust of air and save an engine space.

Meanwhile, such a cylinder head has a problem that the cylinder head receives exhaust heat and a temperature readily becomes high compared to a cylinder head which is separately provided from a manifold. Hence, it has been proposed to improve cooling performance by circulating an engine coolant in surroundings of an exhaust port. More specifically, it has been proposed to form a shape which encircles a circumferential surface of the exhaust port by a water jacket or form a shape of a water jacket such that a flow of the engine coolant meanders (refer to patent literatures 1 and 2).

CITATION LIST

Patent Literature

Patent Literature 1: JP 4262343 A
Patent Literature 2: JP 4098712 A

SUMMARY OF INVENTION

Technical Problem

However, a conventional cylinder head having a built-in manifold adopts a structure which considers that a cooling effect of an engine coolant is important, and does not sufficiently take into account heat radiation performance of an outer surface of the cylinder head. Hence, for example, cooling efficiency of an outer surface side of the cylinder head becomes excessive, exhaust gas in the exhaust port is excessively cooled and the exhaust gas purifying catalyst takes long time to warm up. Further, even when cooling performance at the outer surface of the cylinder head is sufficient, cooling performance inside the cylinder head is insufficient, and a temperature of the engine coolant unintentionally rises in some cases. Thus, the conventional cylinder head having the built-in manifold has a problem that it is difficult to improve cooling performance of the engine and control performance for the cooling performance.

One of objects of the present invention is to provide a cylinder head which has been created in light of the above problem and can improve cooling performance of an engine and control performance for cooling. In addition, the objects of the present invention are not limited to this object, and providing a function and an effect which derives from each component described in a mode for carrying out the invention described below and which cannot be provided by a conventional technique is also understood as other objects of the present invention.

Solution to Problem (1) A cylinder head of an engine disclosed herein is a cylinder head that has a built-in exhaust manifold of an engine and includes an outer coolant passage (e.g. outer water jacket) and an inner coolant passage (e.g. inner water jacket).

An engine coolant circulates in the outer coolant passage, and the outer coolant passage is disposed along the manifold positioned at a side of an outer surface of the cylinder head. Meanwhile, the inner coolant passage has a shape that is branched from the outer coolant passage and then joins, and is disposed along the outer coolant passage and at an inner side of the cylinder head.

Thus, inside the cylinder head, water channels of two systems are formed as coolant passages for cooling the surroundings of the manifold. A flow velocity of the coolant in each water channel is determined according to a sectional area or a shape of each water channel.

(2) Further, the outer coolant passage is preferably disposed along the manifold and in a semicircular arc shape when seen from a top view of the engine while the manifold is connected to an outer cylinder positioned at the side of the outer surface of the engine. In this case, the inner coolant passage is preferably disposed along the manifold and in a semicircular arc shape and closer to an inside than the outer coolant passage when seen from the top vide of the engine while the manifold is connected to an inner cylinder positioned at an inner side of the engine.

For example, in case of a cylinder head of an inline-four cylinder engine, preferably, the outer coolant passage is disposed along the manifold connected to a cylinder #1 and a cylinder #4, and the inner coolant passage is disposed along the manifold connected to a cylinder #2 and a cylinder #3.

(3) Further, the cylinder head preferably includes a connection coolant passage that connects the outer coolant passage and the inner coolant passage and is disposed adjacent to a bifurcated portion at which branch pipes of the manifold join.

In addition, a flow passage sectional area of the connection coolant passage is preferably smaller than a flow passage sectional area of each of the outer coolant passage and the inner coolant passage. Consequently, a velocity of the coolant flowing in the connection coolant passage rises and cooling efficiency at the bifurcated portion improves.

The cylinder head of the inline-four cylinder engine has the three bifurcated portions. That is, the three bifurcated portions include three of a portion at which the branch pipes connected to the cylinder #1 and the cylinder #2 join, a portion at which the branch pipes connected to the cylinder #2 and the cylinder #3 join, and a portion at which the branch pipes connected to the cylinder #3 and the cylinder #4 join. The connection coolant passage is preferably disposed adjacent to at least one of the bifurcated portions and is more preferably disposed adjacent to all three bifurcated portions.

(4) The outer coolant passage and the inner coolant passage are preferably disposed forming a pair that sandwiches the manifold from above and below. In addition, directions of "above and below" described herein refer to upper and lower directions based on the manifold.

(5) The outer coolant passage preferably includes a dent at a position meeting a screw hole, the dent having a shape dented toward an inside of the cylinder head and the screw hole being bored in a fastening surface between the cylinder head and an exhaust pipe.

For example, the outer coolant passage is preferably formed in a shape projecting in the fastening surface across the screw hole bored in the fastening surface between the cylinder head and the exhaust pipe. In other words, the outer coolant passage is preferably formed at one side and the other side of the screw hole at predetermined intervals. That is, the screw hole is preferably sandwiched from at least two directions (from, for example, the left and the right) by the outer coolant passage.

(6) The outer coolant passage preferably includes a guide that guides a circulation direction of the coolant along an outer circumference of the screw hole.

In this case, the guide preferably has a curved shape which guides the coolant toward a portion of a shape of the outer coolant passage which projects in the fastening surface.

(7) The cylinder head preferably includes a coolant rib that is formed by continuously forming a swelled portion in a string shape and is disposed outside the outer coolant passage, the swelled portion being swelled outward from the outer surface of the cylinder head.

Thus, a contact area between the surroundings of the outer coolant passage and outdoor air increases, and heat radiation performance of the outer surface of the cylinder head further improves.

(8) Further, the cylinder head preferably includes an upper coolant passage (e.g. upper water jacket) and a lower coolant passage (e.g. lower water jacket). For example, the engine coolant circulates in the upper coolant passage, and the upper coolant passage is planarly disposed along a top surface of the manifold. Meanwhile, the engine coolant circulates in the lower coolant passage, and the lower coolant passage is planarly disposed along a bottom surface of the manifold. Further, one of the upper coolant passage and the lower coolant passage is formed in a shape protruding toward an outside of the engine compared to the other one of the upper coolant passage and the lower coolant passage.

Thus, inside of the cylinder head, water channels of upper and lower systems are formed as coolant passages which cool the surroundings of the manifold. A flow velocity of the coolant in each water channel is determined according to a sectional area and a shape of each water channel.

(9) Further, the lower coolant passage is preferably formed in a shape protruding toward an outside of the engine compared to the upper coolant passage.

(10) Further, the lower coolant passage is preferably formed in a shape and near a flange, the shape protruding toward the outside of the engine and the flange forming a fastening surface with respect to an exhaust pipe connected to a downstream side of the manifold.

(11) Preferably the upper coolant passage is formed in a shape of a half-disk shape encircled by the manifold and a cylinder bank of the engine, the manifold being connected to the outer cylinder positioned at the side of the outer surface of the engine, and the lower coolant passage has a shape of a half-disk shape protruding toward an outside of the engine compared to the upper coolant passage.

Advantageous Effects of Invention

The cylinder head of the engine according to the present disclosure includes coolant passages of two systems (e.g. an outer water jacket and an inner water jacket) in the cylinder head, so that it is possible to reduce each flow passage sectional area while securing a total flow passage sectional area and increase a flow velocity of a coolant. Consequently, it is possible to improve cooling efficiency in the surroundings of the manifold built in the cylinder head.

Further, at the outer surface side and the inner side of the cylinder head, heat radiation performance from the cylinder to the outside differs, and therefore cooling capability which the coolant passages need to satisfy also slightly differs. Meanwhile, according to the cylinder head of the engine according to the present disclosure, the cooling passages are separately formed at the outer surface side and the inner side of the cylinder head, respectively. Consequently, it is possible to provide cooling capability which is suitable to each coolant passage, and improve cooling performance of the engine and control performance for the cooling performance.

DESCRIPTION OF EMBODIMENTS

A cylinder head of an engine applied to a vehicle will be described with reference to the drawings. In addition, the following embodiment is only an exemplary embodiment, and does not exclude various deformations and application of a technique which are not described in the following embodiment. Each component in the present embodiment can be variously deformed and carried out without departing from a spirit of the present embodiment, and can be selected when necessary or can be optionally combined.

1. Engine Configuration

Figure 1:
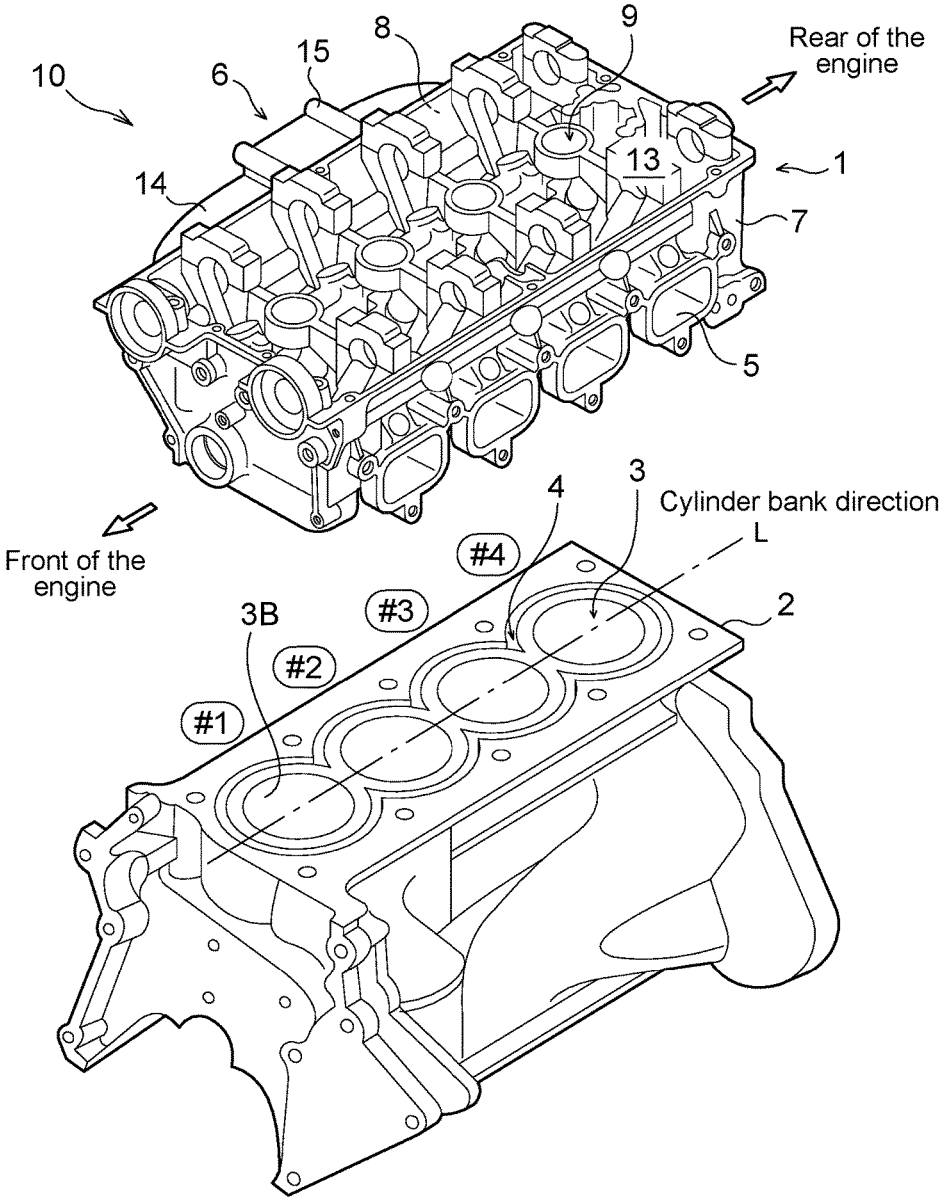
FIG. 1 is a perspective view illustrating a cylinder head of an engine according to one embodiment.

A cylinder head 1 according to the present embodiment is fastened and fixed to a cylinder block 2 of an engine 10 illustrated in FIG. 1. In the following description, a side of the cylinder head 1 to which the cylinder block 2 is fixed is a downward side, and an opposite side is an upper side. A bottom surface of the cylinder head 1 and a top surface of the cylinder block 2 are both formed in planar shapes, and the cylinder head 1 and the cylinder block 2 are coupled in a state where a gasket for securing airtightness is interposed in a joint surface of the bottom surface and the top surface.

A head cover is attached to a top surface of the cylinder head 1, and a crank case and an oil pan are attached to a bottom surface of the cylinder block 2. Further, at a front side of the engine 10 (a lower left direction in FIG. 1), accessories and power transmission pulleys (a crank pulley, a timing pulley, a sprocket and the like) of the engine 10 are provided. Meanwhile, a drive plate and a flywheel are provided at a rear side of the engine 10 (an upper right direction in FIG. 1), and are connected to various devices (e.g. a transmission, a rotating electrical machine and the like) at a downstream side of a power train.

This engine 10 is a water-cooled multi-cylinder gasoline engine. Inside the engine 10, a plurality of cylinder bores 3 (which is cylinders referred to simply as cylinders 3 below) bored in a hollow cylindrical shape is disposed as a bank. The engine 10 illustrated in FIG. 1 is the four cylinder engine 10 whose four cylinders 3 are disposed in line. Numbers of the cylinders 3 are expressed as #1, #2, #3 and #4 in order from the front side of the engine 10.

A lower end of a piston sliding in each cylinder 3 is connected to a crank shaft via a connecting rod. A direction (bank direction) in which the cylinders 3 are aligned in a bank shape will be referred to as a cylinder bank direction L. The cylinder #1 and the cylinder #4 are each positioned at an outer surface side of each cylinder 3 (an end of the cylinder bank direction L) and therefore will be referred to as an "outer cylinder". By contrast with this, the cylinder #2 and the cylinder #3 are each positioned at an inner side of each cylinder 3 (closer to an inside than the outer cylinders) and therefore will be referred to as an "inner cylinder".

Figure 2:
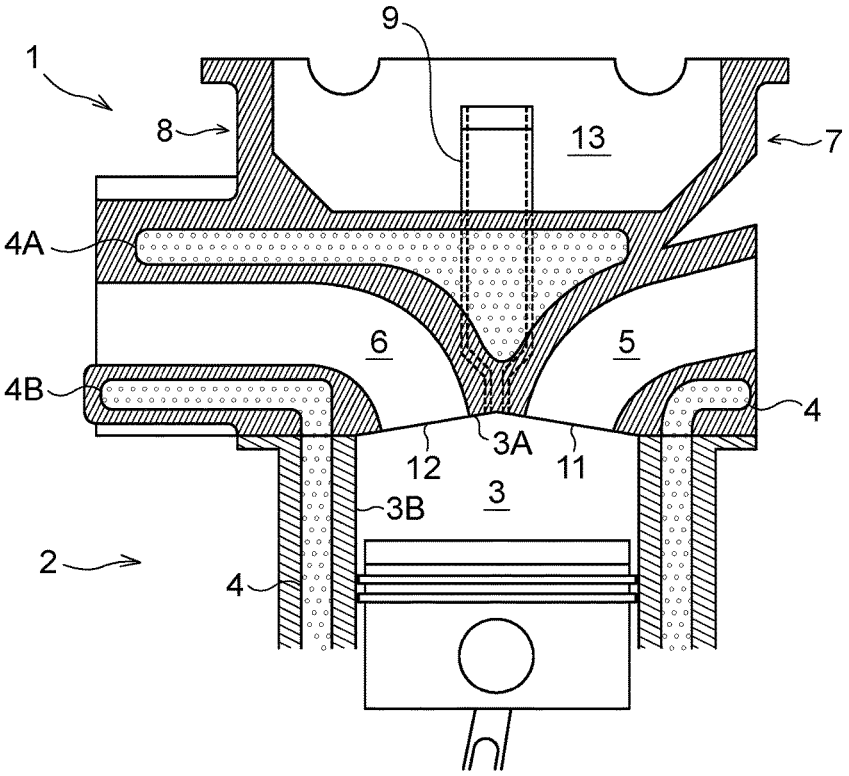
FIG. 2 is a longitudinal sectional view of the engine in FIG. 1

In surroundings of each cylinder 3, a water jacket 4 which is dug in a curved shape along a cylindrical surface 3B of each cylinder 3 is disposed. The water jacket 4 is formed to encircle an outer circumferential side of the cylinders 3. Thus, the nearly entire cylinders 3 are cooled by an engine coolant circulating inside the water jacket 4. The cylinder block 2 illustrated in FIGS. 1 and 2 is an open deck type, and a top side of the water jacket 4 is opened in a top surface of the cylinder block 2 and continues to water jackets 4, 4A and 4B formed at a cylinder head 1 side. That is, the water jacket 4 is continuously formed not only inside the cylinder block 2 but also inside the cylinder head 1, and cools the entire engine 10. Thus, an outer circumference of suction ports 5 (suction flow passages), an exhaust port 6 and the like connected to the cylinders 3 are cooled by an engine coolant.

As illustrated in FIG. 2, a recess which serves as a ceiling surface 3A of the cylinder 3 (a ceiling surface of a combustion room) is formed in a bottom surface of the cylinder head 1. An outline shape of the ceiling surface 3A has the same circular shape as those of the cylinders 3, and a recess shape is, for example, a pent roof shape (triangular roof type) or a hemispherical shape. Further, the suction ports 5 and the exhaust port 6 are connected to this ceiling surface 3A. Each suction port 5 is a hollow pipe passage in which suction air injected into the cylinders 3 circulates, and has openings in both of the ceiling surface 3A and a suction side sidewall 7 of the cylinder head 1. Similarly, the exhaust port 6 is a hollow pipe passage in which exhaust air circulates, and has openings in both of the ceiling surface 3A and an exhaust side sidewall 8 of the cylinder head 1. Flow passage shapes of the suction ports 5 and the exhaust port 6 have smoothly curved shapes. The exhaust port 6 according to the present embodiment is a multi-branched exhaust flow passage which functions an exhaust manifold (multi-branched pipe).

At ends of the suction ports 5 and the exhaust port 6 at a combustion chamber side, suction valves and exhaust valves which are not illustrated are provided. An end opening of each suction port 5 which is opened and closed by each suction valve will be referred to as a suction valve hole 11, and an end opening of the exhaust port 6 which is opened and closed by each exhaust valve will be referred to as an exhaust valve hole 12. Further, in the ceiling surface 3A of the cylinder 3, an ignition plug insertion hole 9 which penetrates up to the top surface of the cylinder head 1 is formed. This ignition plug insertion hole 9 is a portion to which an ignition plug is fixed, and is provided one by one to each cylinder 3.

As illustrated in FIG. 1, around the ignition plug insertion hole 9 at an upper portion of the cylinder head 1, a valve chamber 13 is formed. Inside the valve chamber 13, a valve train which drives the suction valves and the exhaust valves is housed. The valve train according to the present embodiment is a DOHC variable valve train which supports a multi-valve. The two suction valve holes 11 are provided to one cylinder 3. Similarly, the two exhaust valve holes 12 are also provided to one cylinder 3. The variable valve train freely controls operations of the suction valves and the exhaust valves which open and close these valve holes 11 and 12.

This variable valve train has a function of changing valve lift amounts and valve timings of individual suction valves and exhaust valves individually or in synchronization with each other. For example, in the variable valve train, a variable valve lift mechanism and a variable valve timing mechanism are built in as mechanisms which change a swing amount and a swing timing of a rocker arm. These specific structures are arbitrary, and a known variable valve train can be applied as a valve train according to the present embodiment.

2. Suction Exhaust Port

Figure 3A:
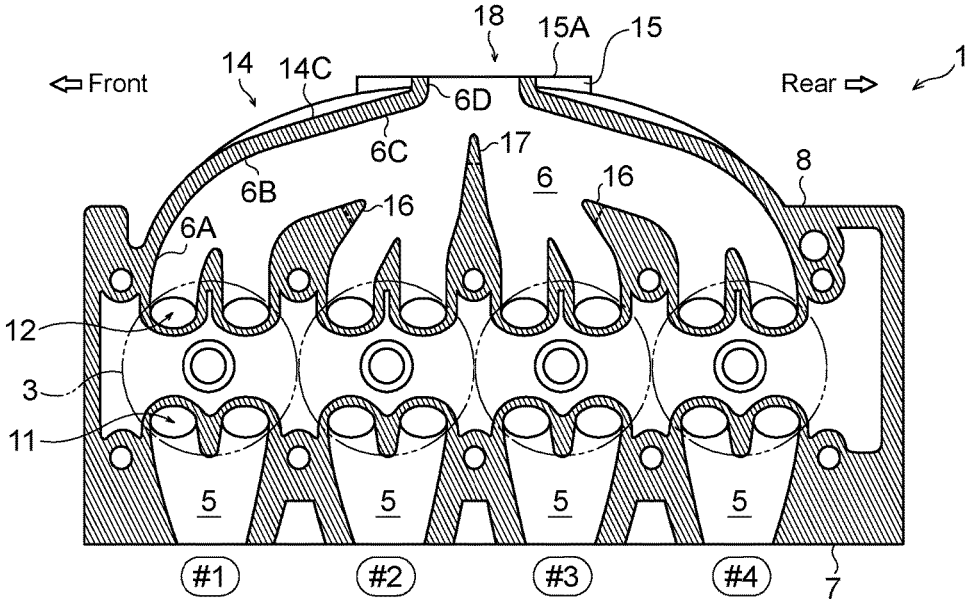
FIG. 3(A) is a horizontal sectional view illustrating shapes of suction/exhaust ports in the cylinder head.

FIG. 3(A) illustrates schematic shapes of the suction ports 5 and the exhaust port 6 inside the cylinder head 1.

Each suction port 5 is provided one by one to each cylinder 3, and has a shape which is branched into two whose downstream ends are connected to both of a pair of suction valve holes 11 formed in each cylinder 3. A transparent shape of each suction port 5 when seen from a top view of the engine 10 has a Y shape as illustrated in FIG. 3(A). Further, each suction port 5 connected to each cylinder 3 is independently opened in the suction side sidewall 7 without joining each other in the cylinder head 1. Hence, the number of openings at upstream ends of the suction ports 5 formed in the cylinder head 1 is four which is the same as the number of cylinders 3.

Figure 3B:
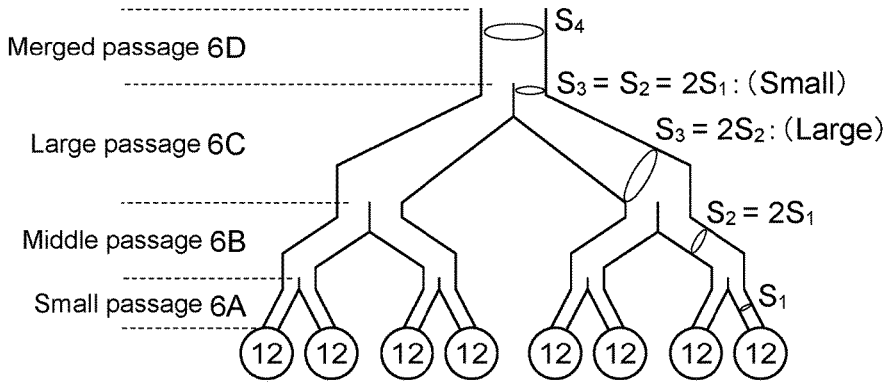
FIG. 3(B) is a schematic view for explaining a structure of the exhaust port.

Meanwhile, the entire exhaust port 6 (exhaust manifold) is built in the cylinder head 1. That is, as illustrated in FIG. 3(A), an upstream end of the exhaust port 6 has a shape branched into eight which are connected with the individual exhaust valve holes 12. Further, a downstream end of the exhaust port 6 has a shape in which the individual branched passages are merged as one passage. As schematically illustrated in FIG. 3(B), the branched shape of the exhaust port 6 is a tree-like shape (tree diagram shape) whose number of branches increases toward the upstream side.

In this regard, each of the thinnest passages connected to the exhaust valve holes 12 (a branch pipe positioned at the most upstream side of the exhaust port 6) will be referred to as a small passage 6A. A sectional area $S_1$ of one small passage 6A is set to a size which corresponds to an opening area of one exhaust valve hole 12 (which is, for example, the substantially same as an opening area of each exhaust valve hole 12). Further, a pair of small passages 6A connected to the same cylinder 3 join at a position relatively close to the exhaust valve hole 12 to form a middle passage 6B (a branch pipe positioned at an intermediate portion of the exhaust port 6). A sectional area $S_2$ of the middle passage 6B is set to a size which corresponds to the total sectional area $2S_1$ of a pair of small passages 6A which join this middle passage 6B (which is, for example, the substantially same size as that of a total sectional area $2S_1$).

Further, the middle passages 6B connected to the two neighboring cylinders 3 join at a relatively distant position from the exhaust valve holes 12 to form a large passage 6C. In an example illustrated in FIG. 3(A), the middle passages 6B connected to the cylinder #1 and the cylinder #2 join to form the large passage 6C, and the middle passages 6B connected to the cylinder #3 and the cylinder #4 join to form the large passage 6C.

A sectional area $S_3$ of each large passage 6C is set smaller (narrower) toward a downstream side of an exhaust air circulation direction. An upstream end of each large passage 6C is set to a size which corresponds to a total sectional area $2S_2$ of a pair of middle passages 6B joining this large passage 6C (which is, for example, the substantially same area as the total sectional area $2S_2$). Meanwhile, a downstream end of the large passage 6C is set to a size which corresponds to the sectional area $S_2$ of one middle passage 6B (which is, for example, the substantially same size as the sectional area $S_2$).

Each portion sandwiched by a pair of middle passages 6B at the upstream side of the joining portion at which a pair of middle passages 6B join will be referred to as a bifurcated portion 16. Each bifurcated portion 16 can be defined as an overlapping area of a portion whose distance to one middle passage 6B is a predetermined distance or less (an inner portion of a cylinder whose circumferential surface of one middle passage 6B is expanded in an enlarged diameter direction), and a portion whose distance to the other middle passage 6B is a predetermined distance or less (an inner portion of a cylinder whose circumferential surface of the other middle passage 6B is enlarged in the enlarged diameter direction).

In the example illustrated in FIG. 3(A), a triangular portion sandwiched by an exhaust airflow from the cylinder #1 and an exhaust airflow from the cylinder #2 corresponds to the bifurcated portion 16. A triangular portion sandwiched by an exhaust airflow from the cylinder #3 and an exhaust airflow from the cylinder #4 also corresponds to the bifurcated portion 16. In addition, a specific stereoscopic shape of each bifurcated portion 16 can be arbitrarily set according to a heat distribution inside the cylinder head 1.

The two large passages 6C join at a position close to the exhaust side sidewall 8 of the cylinder head 1 to form a merged passage 6D in which exhaust air from all cylinders 3 circulates. A sectional area $S_4$ of the merged passage 6D is set according to sizes of an exhaust pipe, a catalyst device, a turbocharger and the like connected to a downstream side of the merged passage 6D. Meanwhile, at a joining position of the two large passages 6C, a downstream end of the large passage 6C (i.e., an inlet of the merged passage 6D) has a thinly narrowed shape compared to an upstream end of the large passage 6C. Thus, an exhaust air flow velocity at the joining position of a pair of small passages 6A and an exhaust air flow velocity at the inlet of the merged passage 6D become the substantially same. Consequently, a flow velocity of exhaust air in the merged passage 6D hardly decreases and exhaust efficiency improves.

Similar to the above bifurcated portions 16, a portion sandwiched by the two large passages 6C will be referred to as a second bifurcated portion 17. The second bifurcated portion 17 can be defined as, for example, an overlapping area of a portion whose distance to one large passage 6C is a predetermined distance or less, and a portion whose distance to the other large passage 6C is the predetermined distance or less. In the example illustrated in FIG. 3(A), a triangular portion sandwiched by exhaust airflows from the cylinders #1 and #2 and exhaust air flows from the cylinders #3 and #4 corresponds to the second bifurcated portion 17. A specific stereoscopic shape of the second bifurcated portion 17 can be arbitrarily set according to a heat distribution inside the cylinder head 1.

In addition, the merged passage 6D is preferably formed as short as possible. That is, the joining position of the two large passages 6C is preferably set to a position as close to an outlet of the exhaust airflow (a downstream end of the merged passage 6D) as possible (in a range that a distance from a downstream end surface of the merged passage 6D is a predetermined distance or less).

Figure 4:
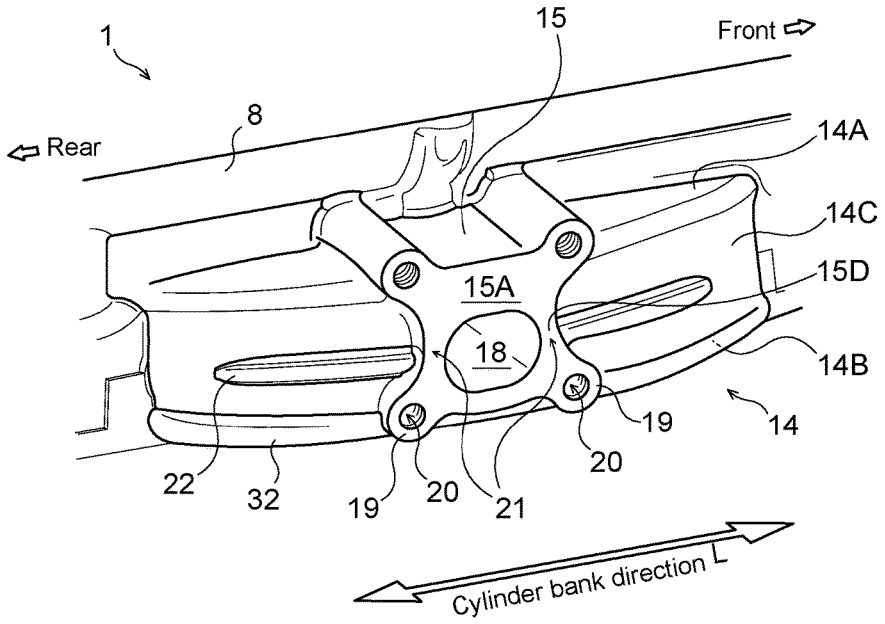
FIG. 4 is a perspective view illustrating enlarged main parts of the cylinder head.

FIG. 4 is a perspective view illustrating the cylinder head 1 from the exhaust side sidewall 8 side. The exhaust side sidewall 8 is provided with a protruding portion 14 which bulges in a half-moon shape toward an outside of the cylinder head 1 to encircle the entire exhaust port 6. This protruding portion 14 has an outline shape of a semicircular arc shape when seen from the top view of the engine 10, and a center portion facing the merged passage 6D of the exhaust port 6 bulges toward an outside in a horizontal direction. As illustrated in FIG. 4, the entire shape of the protruding portion 14 can be compared to a shape formed by cutting part of a flat cylinder along a planar shape vertical to a top surface of the cylinder (a cut whole cake shape).

A top surface 14A and a bottom surface 14B of the protruding portion 14 have planar shapes, respectively, and are provided nearly in parallel. Further, a position of the top surface 14A of the protruding portion 14 is set below the top surface of the cylinder head 1, and a position of the bottom surface 14B of the protruding portion 14 is set above the bottom surface of the cylinder head 1 (or on the same plane as the bottom surface of the cylinder head 1). A side surface 14C (outer surface) of the protruding portion 14 protruding toward the outside in the horizontal direction has a curved shape of an arch formed by elongating a cut arc in the upper and lower directions of the engine 10.

In addition, a shape of the protruding portion 14 is preferably formed in as small a shape which houses at least the entire exhaust port 6 as possible. In other words, the exhaust port 6 is preferably disposed inside the protruding portion 14 and along the side surface 14C of the protruding portion 14. As illustrated in FIG. 3(A), a layout of the exhaust port 6 when seen from the top view of the engine 10 is such a layout that the small passages 6A, the middle passage 6B and the large passage 6C which circulate exhaust air from the cylinder #1 are disposed along the side surface 14C of the protruding portion 14. Similarly, the small passages 6A, the middle passage 6B and the large passage 6C which circulate exhaust air from the cylinder #4 are disposed along the side surface 14C of the protruding portion 14.

A single opening (referred to as an exhaust port 18 below) which serves as the downstream end of the merged passage 6D is disposed in a center of the exhaust side sidewall 8 in the cylinder bank direction L. That is, when the cylinder head 1 is seen from the exhaust side sidewall 8 side, the exhaust port 18 is formed at a position between the cylinder #2 and the cylinder #3. Further, as illustrated in FIG. 4, a flange 15 including a fastening surface 15A of a planar shape vertical to the exhaust air circulation direction is formed around the exhaust port 18. The flange 15 is a portion at which an downstream side exhaust pipe which is not illustrated (including a pipe material for connecting the catalyst device, the turbocharger and the like) is fastened and fixed. The fastening surface 15A of the flange 15 is formed around the exhaust port 18 to annularly encircle upper, lower, left and right sides of the exhaust port 18.

The flange 15 is provided with a plurality of bosses 19 to which fastening tools are attached. In each boss 19, a fastening hole (screw hole) including in an inner cylindrical surface a groove in which each fastening tool is screwed is bored. A boring direction of each fastening hole 20 is a direction vertical to the fastening surface 15A. Positions of the bosses 19 are set at predetermined intervals in a circumferential direction of the exhaust port 18. In an example illustrated in FIG. 4, the bosses 19 are formed at four corners of the annularly disposed fastening surface 15A.

The two bosses 19 of these bosses 19 positioned at an upper side are formed to bulge slightly above the top surface 14A of the protruding portion 14. Meanwhile, the two bosses 19 positioned at a lower side are formed such that lower ends of these bosses 19 substantially match with the bottom surface 14B (the lower ends do not protrude below the bottom surface 14B of the protruding portion 14). Consequently, a space below the bottom surface 14B of the protruding portion 14 is secured to prevent, for example, an interference with the cylinder block 2.

Figure 6A:
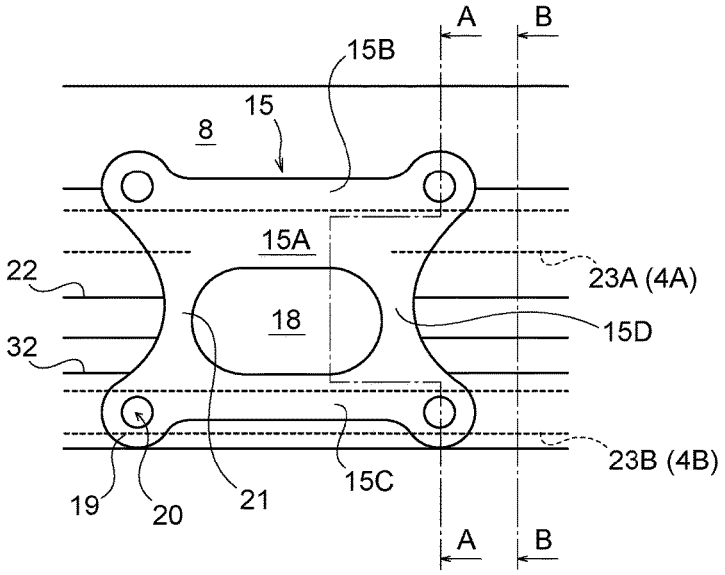
FIG. 6(A) is a side view illustrating enlarged main parts of the cylinder head.
Figure 6B:
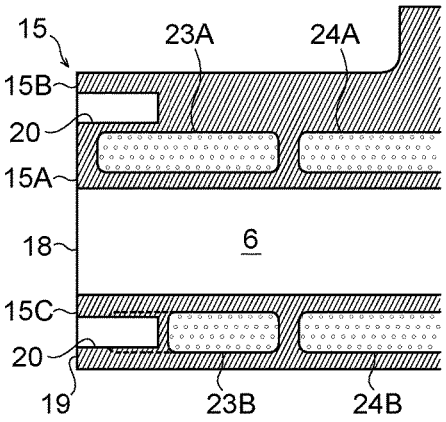
FIG. 6(B) is a sectional view taken along an A-A line in FIG. 6(A) and FIG. 6(C) is a sectional view taken along a B-B line in FIG. 6(A).

Hereinafter, the fastening surface 15A of the flange 15 will be described in detail. As illustrated in FIG. 6(A), a portion of the fastening surface 15A sandwiched by a pair of fastening holes 20 bored in the two bosses 19 positioned at the upper side will be referred to as an upper fastening area 15B (first fastening surface). The upper fastening area 15B is disposed to connect a pair of upper fastening holes 20. Similarly, a portion sandwiched between a pair of fastening holes 20 bored in the two bosses 19 positioned at the lower side will be referred to as a lower fastening area 15C (second fastening surface). The lower fastening area 15C is disposed to connect a pair of lower fastening holes 20.

At portions of the flange 15 positioned in the cylinder bank direction L based on a center of the exhaust port 18 (left and right portions of the exhaust port 18 when the flange 15 is seen from the front), thin portions 21 formed by making the thickness of the flange 15 (the width of the fastening surface 15A) thinner than other portions are formed. The thickness of the flange 15 described herein refers to a length from a rim of the exhaust port 18 on the surface of the flange 15 to a rim of an outer side of the flange 15. The thin portions 21 are disposed at both left and right sides across the exhaust port 18. Consequently, the thickness in the surroundings of the merged passage 6D becomes thin and heat radiation performance improves.

The shape of each thin portion 21 is a curved shape which connects the bosses 19 such that the thickness of the flange 15 becomes thinner apart from the upper and lower bosses 19 (at a position closer to the center in the upper and lower directions) when the exhaust side sidewall 8 (exhaust port 18) is seen from the front of the exhaust side sidewall 8. The shape of the flange 15 seen from the front view is a drum shape whose longitudinal sides of a square shape are curved inward. The fastening surface 15A at the thin portions 21 will be referred to as center fastening areas 15D (thin fastening surface) below. The center fastening areas 15D are areas sandwiched by the upper fastening area 15B and the lower fastening area 15C, form part of the fastening surface 15A and are formed to have narrower widths than the other portions (the upper fastening area 15B and the lower fastening area 15C).

As illustrated in FIG. 4, heat radiation ribs 22 elongated from the thin portions 21 of the flange 15 toward the cylinder bank direction L are formed to bulge on the side surface 14C of the protruding portion 14. Each heat radiation rib 22 is an elongated protrusion (a string-shaped protrusion) formed by continuously forming in a string shape a protrusion protruding from the surface of the side surface 14C to an outside in a plate thickness direction. The heat radiation ribs 22 are formed one by one on the left and the right of the flange 15. Further, a position at which each heat radiation rib 22 and each thin portion 21 are in contact is a position at which the thickness of the flange 15 is the thinnest. Thus, the heat radiation ribs 22 function to improve rigidity and strength of the side surface 14C of the protruding portion 14 and also function to improve rigidity and strength of the flange 15.

Further, each heat radiation rib 22 is formed to bulge from the side surface 14C of the protruding portion 14, so that an area which is in contact with air increases and heat radiation performance improves. In addition, each heat radiation rib 22 is formed to continue to each thin portion 21 which encourages heat radiation, so that exhaust heat passing through the exhaust port 18 is readily transmitted to each heat radiation rib 22 via the thin portion 21. Consequently, the exhaust heat is efficiently dissipated. In addition, a length of each heat radiation rib 22 in the cylinder bank direction L, a length of each heat radiation rib 22 in the upper and lower directions (rib width) and a height of each heat radiation rib 22 in the upper and lower directions (rib position) can be optionally set by taking into account fluidity (molten metal flow) for manufacturing the cylinder head 1.

3. Water Jacket

Figure 5A:
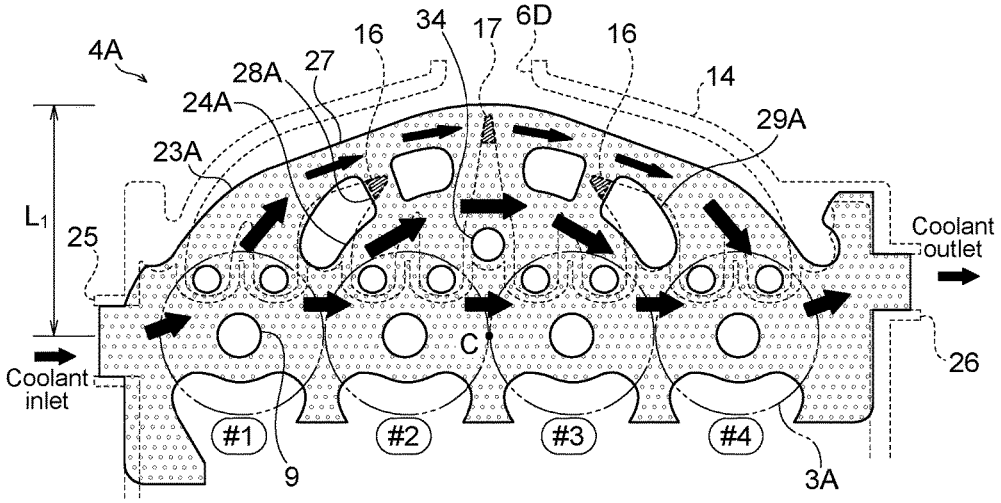
FIG. 5(A) is a horizontal sectional view of an upper water jacket.
Figure 5B:
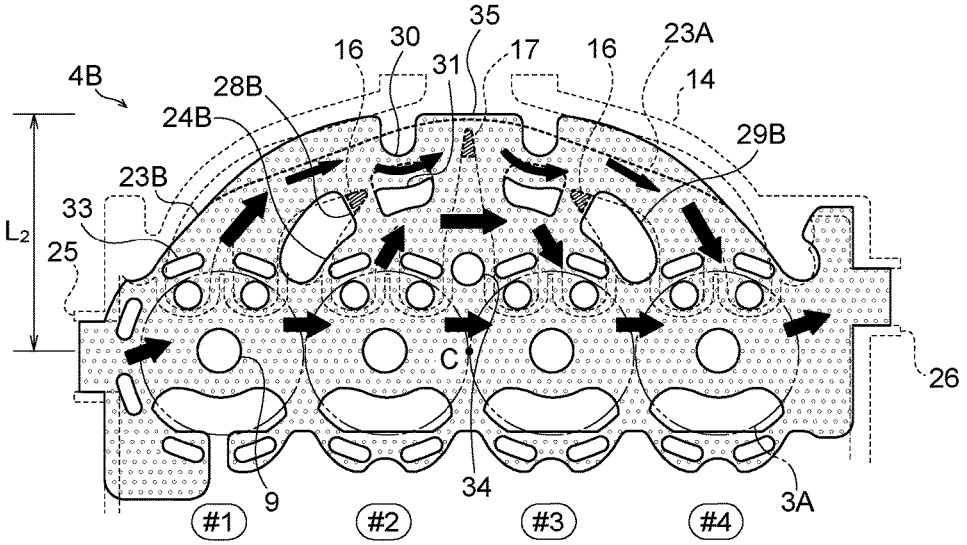
FIG. 5(B) is a horizontal sectional view of a lower water jacket.

FIGS. 5(A) and 5(B) illustrate shapes of the water jacket 4 inside the cylinder head 1. The cylinder head 1 is provided with inner and outer coolant passages of two systems as the water jacket 4 which cools the surroundings of the exhaust port 6 (the exhaust manifold built in the cylinder head 1). Further, these coolant passages of the two systems are formed both at the upper side and the lower side of the exhaust port 6. In the following description, a water jacket 4A indicates the water jacket 4 disposed above the exhaust port 6, and a water jacket 4B indicates the water jacket 4 disposed below the exhaust port 6. In addition, in a bolt hole (bolt hole boss) 34 in FIGS. 5(A) and 5(B), a fastening tool for fastening and fixing the cylinder head 1 and the cylinder block 2 is inserted.

[3-1. Upper Water Jacket]

The upper water jacket 4A (upper coolant passage) is provided with an outer coolant passage 23A and an inner coolant passage 24A. These coolant passages 23A and 24A both continue to the water jacket 4 formed in the cylinder block 2. Reference numeral 25 in FIGS. 5(A) and 5(B) corresponds to a coolant inlet which receives supply of a coolant from a water pump side, and reference numeral 26 corresponds to a coolant outlet. Further, thin broken lines in FIGS. 5(A) and 5(B) are lines corresponding to outlines of the cylinder head 1 (protruding portion 14) and the exhaust port 6, and dashed-two dotted lines are lines corresponding to outlines of the ceiling surfaces 3A of the cylinders 3.

The outer coolant passage 23A is a coolant passage positioned close to the side surface 14C inside the protruding portion 14 (the outer surface side of the cylinder head 1), and is disposed along the exhaust port 6 which circulates exhaust air from the cylinder #1 and the cylinder #4 and at the top surface side of the exhaust port 6. An arrangement shape of the outer coolant passage 23A is a semicircular arc shape when seen from the top view of the engine 10. That is, the outer coolant passage 23A is disposed along the exhaust port 6 (the manifold and an exhaust passage) connected to the outer cylinders. As indicated by black arrows in FIG. 5(A), an upstream of an engine coolant circulation direction is a cylinder #1 side and a downstream thereof is a cylinder #4 side.

The inner coolant passage 24A is a coolant passage disposed closer to the inside of the protruding portion 14 than the outer coolant passage 23A, and is disposed along the exhaust port 6 which circulates exhaust air from the cylinder #2 and the cylinder #3 and at the top surface side of the exhaust port 6. An arrangement shape of the inner coolant passage 24A is a semicircular arc shape smaller than the outer coolant passage 23A when seen from the top view of the engine 10. That is, the inner coolant passage 24A is disposed along the manifold (exhaust passage) connected to the inner cylinder. An upstream of the engine coolant circulation direction is a cylinder #2 side, and a downstream thereof is a cylinder #3 side.

As illustrated in FIG. 5(A), the inner coolant passage 24A has a shape which is branched from the outer coolant passage 23A and then joins. That is, the upper water jacket 4A is branched into the outer coolant passage 23A and the inner coolant passage 24A near the cylinder #1 and then joins near the cylinder #4, and includes a flow passage separated into the two systems. Further, islands 29A in which an engine coolant does not circulate are formed between the outer coolant passage 23A and the inner coolant passage 24A. By dividing a flow of an engine coolant at the top surface side of the cylinder head 1 into two systems, it is possible to decrease a total passage sectional area compared to a case where the flow is not divided. Hence, a flow velocity of the engine coolant rises, and cooling efficiency improves. An increase amount of the flow velocity of the engine coolant corresponds to shapes of the islands 29A and sectional areas of the islands 29A in a flow passage direction.

Hereinafter, a straight line positioned in a middle of a cylindrical shaft of the cylinder #2 and a cylindrical shaft of the cylinder #3 and parallel to these cylindrical shafts is defined as an "engine center C". The inner coolant passage 24A is formed in a shape formed by reducing outer coolant passage 23A around the engine center C (a shape similar to the outer coolant passage 23A). When the outer coolant passage 23A and the inner coolant passage 24A have similar shapes, a flow passage length of the inner coolant passage 24A is shorter than a flow passage length of the outer coolant passage 23A. Hence, a flow passage sectional area of the outer coolant passage 23A is preferably made smaller than a flow passage sectional area of the inner coolant passage 24A to increase the flow velocity of the outer coolant passage 23A in order to equalize cooling efficiency of the outer coolant passage 23A and the inner coolant passage 24A. Alternatively, a small portion of the flow passage sectional area (narrowed portion) is preferably formed on the outer coolant passage 23A.

In the present embodiment, in a range including a center portion of the outer coolant passage 23A facing the merged passage 6D of the exhaust port 6, a narrowed portion 27 which increases a flow velocity of an engine coolant is formed. The narrowed portion 27 is a portion at which a flow passage sectional area is formed smaller than other portions. Thus, a flow of the engine coolant in the outer coolant passage 23A accelerates at a center portion of the protruding portion 14. Meanwhile, at the center portion of this protruding portion 14, the merged passage 6D in which exhaust air exhausted from all cylinders 3 join is formed. That is, the flow velocity of a coolant at the center portion of the protruding portion 14 at which a temperature is readily raised by exhaust heat rises, so that cooling efficiency of the engine 10 improves.

Further, the narrowed portion 27 according to the present embodiment is formed near a connection coolant passage 28 described next. Thus, the flow velocity of the engine coolant circulating in the connection coolant passage 28 rises, and cooling efficiency around the connection coolant passage 28 also rises.

A connection coolant passage 28A which connects both of the outer coolant passage 23A and the inner coolant passage 24A is formed between the outer coolant passage 23A and the inner coolant passage 24A. The connection coolant passage 28A is disposed at a position adjacent, in the upper and lower directions, to the bifurcated portion 16 and the second bifurcated portion 17 at which the branch pipes of the exhaust port 6 join. That is, as illustrated in FIG. 5(A), a position of the connection coolant passage 28A is set to a position (hatched portion) which overlaps the bifurcated portion 16 and the second bifurcated portion 17, respectively, when seen from the top view of the engine 10. An elongation direction of the connection coolant passage 28A is compared to a radiation direction from the engine center C. Further, one end of the connection coolant passage 28A is connected to a portion of the outer coolant passage 23A whose flow passage sectional area is narrowed by the narrowed portion 27. Hence, the Venturi effect suctions the engine coolant toward the outer coolant passage 23A whose flow velocity is fast, and the engine coolant circulates in each connection coolant passage 28A without stagnating therein.

The connection coolant passage 28A is a flow passage of the engine coolant which penetrates the islands 29A, and functions to cool the islands 29A and surroundings of the islands 29A. The flow passage sectional area of the connection coolant passage 28A is set to a smaller value than flow passage sectional areas of the outer coolant passage 23A and the inner coolant passage 24A. That is, as illustrated in FIG. 5(A), the connection coolant passage 28A is a thinner coolant passage than other portions. Consequently, the flow velocity of the engine coolant circulating in the connection coolant passage 28A rises, and cooling efficiency of the islands 29A and the surroundings of the islands 29A improves.

An entire shape of the outer coolant passage 23A and the inner coolant passage 24A is roughly a planar shape which is disposed along the top surface of the exhaust port 6 and in nearly parallel to the top surface 14A of the protruding portion 14. More specifically, the entire shape is a half-disk shape encircled by the exhaust port 6 and a cylinder bank connected to outer cylinders (the cylinder #1 and the cylinder #4) of the engine 10. In this regard, FIG. 6(A) illustrates the flange 15 when seen from the front of the exhaust side sidewall 8, and outlines (broken lines) illustrating a perspective view of the water jacket 4A formed inside the protruding portion 14.

The outer coolant passage 23A and the inner coolant passage 24A are disposed below these fastening holes 20 without interfering two upper fastening holes 20 among the four fastening holes 20 formed in the fastening surface 15A. That is, at a back side of the upper fastening area 15B sandwiched between the two upper bosses 19 of the fastening surface 15A, the upper water jacket 4A is not disposed. In other words, the upper fastening area 15B disposed to connect the two upper fastening holes 20 is disposed in an area which does not overlap the upper water jacket 4A when seen from the front view of the flange 15. Further, the upper fastening area 15B and both of the two fastening holes 20 positioned at both left and right ends of the upper fastening area 15B are disposed without overlapping the upper water jacket 4A. Hence, part of the upper fastening area 15B is not locally cooled excessively by the upper water jacket 4A, and a heat distribution is made uniform and a fastening stress distribution of the upper fastening area 15B also becomes uniform.

[3-2. Lower Water Jacket]

The lower water jacket 4B (lower coolant passage) is also provided with an outer coolant passage 23B and an inner coolant passage 24B. In addition, the lower water jacket 4B continues to the upper water jacket 4A near the ceiling surfaces 3A of the cylinders 3. Meanwhile, in the protruding portion 14, the upper and lower water jackets 4A and 4B are independent from each other.

Further, the lower water jacket 4B continues to the water jacket 4 at the cylinder block 2 side, too, via openings 33 formed in the bottom surface of the cylinder head 1. As illustrated in FIG. 5(B), a plurality of openings 33 is formed to encircle outer circumferences of the ceiling surfaces 3A of the cylinders 3.

The outer coolant passage 23B is a coolant passage positioned close to the side surface 14C inside the protruding portion 14 (at the outer surface side of the cylinder head 1), and is disposed along the exhaust port 6 which circulates exhaust air from the cylinder #1 and the cylinder #4 and at the bottom surface side of the exhaust port 6. Similar to the outer coolant passage 23A, an arrangement shape of the outer coolant passage 23B is a semicircular arc shape when seen from the top view of the engine 10. That is, the outer coolant passage 23B is disposed along the exhaust port 6 (the manifold and the exhaust passage) connected to the outer cylinders. Thus, the exhaust port 6 is sandwiched from above and below by the outer coolant passages 23A and 23B which form a pair. As indicated by the black arrows in FIG. 5(B), the upstream of the engine coolant circulation direction is the cylinder #1 side and the downstream thereof is the cylinder #4 side.

This outer coolant passage 23B is formed slightly larger than the upper outer coolant passage 23A when seen from the top view of the engine 10. That is, a distance (maximum protrusion dimension) $L_2$ of the lower outer coolant passage 23B from the engine center C to a point of the largest distance is set larger than a maximum protrusion dimension $L_1$ of the upper outer coolant passage 23A ($L_1<L_2$). Hence, when seen from the top view of the engine 10, an outline of the lower outer coolant passage 23B protrudes from the outline of the upper outer coolant passage 23A as indicated by a bold broken line in FIG. 5(B). A position at which the outer coolant passage 23B protrudes is the center portion facing the merged passage 6D of the exhaust port 6.

Thus, the outer coolant passage 23B whose maximum protrusion dimension is larger than the upper outer coolant passage 23A is disposed at the bottom surface side of the protruding portion 14, so that heat transfer from the cylinder block 2 side is readily insulated by the outer coolant passage 23B and this heat is easily absorbed by the engine coolant circulating in the outer coolant passage 23B. That is, a heat insulating effect with respect to heat transfer from the cylinder block 2 side improves, and cooling efficiency of the cylinder head 1 significantly improves.

Figure 6C:
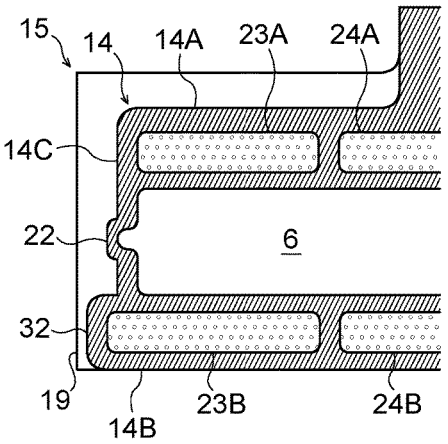

Further, as illustrated in FIGS. 4 and 6(C), coolant ribs 32 which bulge in rib shapes toward the outside are formed in the side surface 14C closer to the outer surface side than the outer coolant passage 23B. Similar to the heat radiation ribs 22, each coolant rib 32 is a protrusion formed by continuously forming in a string shape a bulging portion which bulges in the thickness direction from the surface of the side surface 14C, and the outer coolant passage 23B is disposed at an inner side of this protrusion. That is, the outer coolant passage 23B is formed protruding toward the outer surface side of the cylinder head 1, so that a bulging portion of the side surface 14C bulging toward the outside serves as each coolant rib 32.

Each coolant rib 32 is elongated in the horizontal direction along a ridge of an arch shape formed between the side surface 14C and the bottom surface 14B of the protruding portion 14. In the example illustrated in FIG. 4, the coolant ribs 32 are formed over the entire width of the side surface 14C of the protruding portion 14. Thus, the coolant ribs 32 are formed on the outer surface of the protruding portion 14, so that a surface area of the side surface 14C increases, heat radiation performance improves and cooling performance of the outer coolant passage 23B improves.

As illustrated in FIG. 5(B), the inner coolant passage 24B is a coolant passage disposed closer to the inside of the protruding portion 14 than the outer coolant passage 23B, and is disposed along the exhaust port 6 which circulates exhaust air from the cylinder #2 and the cylinder #3 and at the bottom surface side of the exhaust port 6. Similar to the inner coolant passage 24A, an arrangement shape of the inner coolant passage 24B is formed in a smaller semicircular arc shape than the outer coolant passage 23A when seen from the top view of the engine 10. That is, the inner coolant passage 24B is disposed along the exhaust port 6 (the manifold and the exhaust passage) connected to the inner cylinders. Thus, the exhaust port 6 is sandwiched from above and below by the inner coolant passages 24A and 24B which form a pair. The upstream of the engine coolant circulation direction is the cylinder #2 side and the downstream thereof is the cylinder #3 side.

The inner coolant passage 24B has a shape which is branched from the outer coolant passage 23B and then joins. That is, the lower water jacket 4B is also branched into the outer coolant passage 23B and the inner coolant passage 24B near the cylinder #1 and then joins near the cylinder #4, and has flow passages separated into two systems. Further, islands 29B in which an engine coolant does not circulate are formed between the outer coolant passage 23B and the inner coolant passage 24B. A flow of the engine coolant at the bottom surface side of the cylinder head 1 is divided into the two systems, so that a total flow passage sectional area decreases compared to a case where the flow is not divided. Consequently, a flow velocity of the engine coolant rises and cooling efficiency improves. An increase amount of the flow velocity of the engine coolant corresponds to shapes of the islands 29B and sectional areas of the islands 29B in the flow passage direction.

The inner coolant passage 24B is compared to a shape formed by reducing the outer coolant passage 23B around the engine center C (a shape similar to the outer coolant passage 23B). When the outer coolant passage 23B and the inner coolant passage 24B have similar shapes, a flow passage length of the inner coolant passage 24B is shorter than a flow passage length of the outer coolant passage 23B. Hence, a flow passage sectional area of the outer coolant passage 23B is preferably made smaller than a flow passage sectional area of the inner coolant passage 24B to equalize the cooling efficiency of the outer coolant passage 23B and the inner coolant passage 24B. Alternatively, a portion of a small flow passage sectional area (narrowed portion) is preferably formed on the outer coolant passage 23B.

As illustrated in FIG. 5(B), in a range including a center portion of the outer coolant passage 23B facing the merged passage 6D of the exhaust port 6, dents 30 each having a shape dented toward the inside of the cylinder head 1 from the side surface 14C (outer surface) of the protruding portion 14 are formed. The dents 30 are formed at positions meeting the two lower bosses 19 (or fastening holes 20) of the bosses 19 of the flange 15. That is, as illustrated in FIG. 5(B), the outer coolant passage 23B is formed across the dents 30 meeting the bosses 19 (fastening holes 20) and in a shape which projects in the surface of the flange 15. Thus, these bosses 19 are cooled from both of a front side and a rear side of the engine 10 by a coolant of the outer coolant passage 23B. Hereinafter, a portion of the outer coolant passage 23B sandwiched by the two bosses 19 and projecting in the surface of the flange 15 will be referred to as a projecting portion 35.

Further, the flow passage sectional area of the outer coolant passage 23B is made smaller by the dents 30, and the flow of the engine coolant in the outer coolant passage 23B is accelerated at the center portion of the protruding portion 14. Hence, a flow velocity of the coolant at the center portion of the protruding portion 14 at which a temperature is readily raised by exhaust heat rises, and cooling efficiency of the engine 10 improves.

Further, guides 31 which guide the engine coolant circulation direction are formed along the two bosses 19 (or the outer circumferences of the fastening holes 20) in the outer coolant passage 23B. As illustrated in FIG. 5(B), the guides 31 are walls of curved shapes which smoothly protrude toward the inside of the projecting portion 35. Each guide 31 has a function of placing in contact with the surface an engine coolant flowing from the cylinder #1 side, and guiding the engine coolant in a direction toward the two bosses 19 (the projecting portion 35). Further, each guide 31 has a function of placing in contact with the surface the engine coolant injected between the two bosses 19 (the projecting portion 35), and causing the engine coolant to quickly flow out to the cylinder #4 side. The guides 31 are formed in the outer coolant passage 23B, so that a cooling effect at outer circumferences of the projecting portion 35, the bosses 19 and the fastening holes 20 is promoted, and a fastening force and connectivity of the flange 15 with respect to an exhaust pipe is secured.

A connection coolant passage 28B which connects the outer coolant passage 23B and the inner coolant passage 24B is formed between the outer coolant passage 23B and the inner coolant passage 24B. The connection coolant passage 28B is disposed adjacent to the bifurcated portion 16 and the second bifurcated portion 17 at which the branch pipes of the exhaust port 6 join. That is, as illustrated in FIG. 5(B), a position of the connection coolant passage 28B is set to a position (hatched portion) which overlaps the bifurcated portion 16 and the second bifurcated portion 17, respectively, when seen from the top view of the engine 10. The connection coolant passage 28B is a flow passage of an engine coolant which penetrates the above islands 29B, and has a function of cooling the islands 29B and surroundings of the islands 29B. In addition, an elongation direction of the connection coolant passage 28B is compared to a radiation direction from the engine center C.

Further, a flow passage sectional area of each connection coolant passage 28B is set to a smaller value than flow passage sectional areas of the outer coolant passage 23B and the inner coolant passage 24B. That is, as illustrated in FIG. 5(B), the connection coolant passage 28B is a thinner coolant passage than other portions. Consequently, a flow velocity of an engine coolant circulating in the connection coolant passage 28B rises, and cooing efficiency of the islands 29B and the surroundings of the islands 29B improves.

Similar to the entire shape of the outer coolant passage 23A and the inner coolant passage 24A, an entire shape of the outer coolant passage 23B and the inner coolant passage 24B is roughly a planar shape disposed along the bottom surface of the exhaust port 6 and in nearly parallel to the bottom surface 14B of the protruding portion 14. More specifically, the entire shape is a half-disk shape encircled by the exhaust port 6 and the cylinder bank connected to the outer cylinders (the cylinder #1 and the cylinder #4) of the engine 10. Such a shape causes the lower water jacket 4B to function as a heat insulating plate which insulates heat transfer between the cylinder head 1 side (upper side) and the cylinder block 2 (lower side).

Meanwhile, unlike the outer coolant passage 23A, a center portion of the outer coolant passage 23B includes the dents 30 and the projecting portion 35. As illustrated in FIG. 6(A), the outer coolant passage 23B and the inner coolant passage 24B are disposed at the same heights as those of the two lower bosses 19 of the four bosses 19 formed in the fastening surface 15A.

That is, the outer coolant passage 23B and the inner coolant passage 24B are formed at such positions that the outer coolant passage 23B and the inner coolant passage 24B interfere with the two lower bosses 19 when seen from the front of the exhaust side sidewall 8. Further, at a back side of the lower fastening area 15C of the fastening surface 15A sandwiched between the two lower bosses 19, the lower water jacket 4B is disposed. In other words, the lower fastening area 15C disposed to connect the two lower fastening holes 20 is disposed in an area which overlaps the lower water jacket 4B when seen from the front of the flange 15. That is, the lower fastening area 15C and both of the two fastening holes 20 positioned at both left and right ends of the lower fastening area 15C are disposed to overlap the lower water jacket 4B. Hence, the entire lower fastening area 15C is uniformly cooled by the lower water jacket 4B, so that a heat distribution becomes uniform and a fastening stress distribution in the lower fastening area 15C also becomes uniform.

In addition, at a back side of the center fastening area 15D between the upper fastening area 15B and the lower fastening area 15C, the water jackets 4A and 4B are not disposed. However, a structure (the thin portions 21 and the heat radiation ribs 22) which mildly dissipates heat by cooling air is applied to this area, so that this area hardly becomes a heat spot, stable cooling performance is secured and a smooth temperature gradient corresponding to a temperature difference between the upper fastening area 15B and the lower fastening area 15C is maintained.

4. Function and Effect

In the following description, in case where the upper and lower outer coolant passages 23A and 23B do not need to be distinguished, the upper and lower outer coolant passages 23A and 23B will be simply referred to as the outer coolant passage 23. Similarly, in case where the upper and lower inner coolant passages 24A and 24B and the upper and lower connection coolant passages 28A and 28B do not need to be distinguished, the inner coolant passages 24A and 24B and the connection coolant passages 28A and 28B will be also referred to as the inner coolant passage 24 and the connection coolant passage 28, respectively.

(1) The cylinder head 1 is provided with the outer coolant passage 23 and the inner coolant passage 24 as the water jacket 4 which cools the manifold (multi-branched) exhaust port 6. Thus, the coolant passages of the two inner and outer systems are formed, so that it is possible to reduce each flow passage sectional area and increase a flow velocity of the coolant while securing the total flow passage sectional area. Consequently, it is possible to improve cooling efficiency of the surroundings of the exhaust port 6 built in the cylinder head 1.

Further, flow velocities of engine coolants in the respective coolant passages 23 and 24 are determined according to flow passage sectional areas and shapes of the coolant passages 23 and 24. In view of the above, it is possible to individually set flow velocities and flow rates of the respective coolant flow passages 23 and 24 of the two systems, and improve cooling efficiency of the cylinder head 1 by taking into account heat radiation performance from the protruding portion 14.

Further, heat radiation performance from the cylinder head 1 to the outside differs between the outer surface side and the inner side of the cylinder head 1, and therefore cooling capability which the water jacket 4 needs to satisfy also slightly differs. Meanwhile, the cylinder head 1 includes the water jacket 4 which is separately provided to the outer surface side and the inner side of the cylinder head 1. Consequently, it is possible to provide cooling capability which is suitable to each cooling passage, and improve cooling performance of the engine 10 and control performance for the cooling performance.

For example, the side surface 14C of the protruding portion 14 is more readily air-cooled than the inside, and cooling capability which the inner coolant passage 24 needs to satisfy is greater than cooling capability which the outer coolant passage 23 needs to satisfy. Hence, the flow passage sectional areas and the shapes of the two coolant passages 23 and 24 are set such that cooling capabilities of the inner coolant passages 24A and 24B are greater than the cooling capability of the outer coolant passage 23, so that it is possible to make uniform a heat distribution of the protruding portion 14 in inside and outside directions and improve cooling efficiency of the cylinder head 1 as a whole.

(2) The outer coolant passages 23A and 23B are disposed along the exhaust path connected to the cylinder #1 and the cylinder #4 which are the outer cylinders and in semicircular arc shapes when seen from the top view of the engine 10. Meanwhile, the inner coolant passages 24A and 24B are disposed along the exhaust path connected to the cylinder #2 and the cylinder #3 which are the inner cylinders and in semicircular arc shapes inside the outer coolant passages 23A and 23B. This coolant passage layout can save a space of the water jacket 4 while enhancing cooling efficiency of the entire exhaust port 6.

(3) The connection coolant passage 28 which connects the outer coolant passage 23 and the inner coolant passage 24 is formed between the outer coolant passage 23 and the inner coolant passage 24. This connection coolant passage 28 is disposed adjacent to the bifurcated portion 16 and the second bifurcated portion 17 at which the branch pipes of the exhaust port 6 join. Consequently, it is possible to improve cooling performance by providing the connection coolant passage 28 to the bifurcated portion 16 and the second bifurcated portion 17 at which a temperature readily becomes high due to exhaust heat.

(4) The water jackets 4A and 4B are disposed forming a pair which sandwiches the manifold exhaust port 6 from above and below. That is, the exhaust path positioned at the outer surface side of the cylinder head 1 is cooled by the two outer coolant passages 23A and 23B from above and below, and the exhaust path positioned at the inner side of the cylinder head 1 is cooled by the two inner coolant passages 24A and 24B from above and below. Further, the bifurcated portion 16 and the second bifurcated portion 17 at which the pipe branches join are cooled by the two connection coolant passages 28A and 28B from above and below. Consequently, it is possible to uniformly cool the exhaust path, make a heat concentration uniform and further improve cooling efficiency by disposing the water jackets 4A and 4B above and below the exhaust path.

Particularly, in the cylinder head 1, the bifurcated portion 16 and the second bifurcated portion 17 are sandwiched by a pair of connection coolant passages 28 from above and below. Consequently, it is possible to further improve cooling performance of the cylinder head 1.

(5) At the center portion of the outer coolant passage 23B, the dents 30 which each have a shape dented toward the inside of the cylinder head 1 from the side surface 14C (outer surface) of the protruding portion 14 are formed, and the bosses 19 are disposed inside the dents 30. That is, the bosses 19 are sandwiched by the outer coolant passage 23B from the left and the right, and are cooled from both of the front side and the rear side of the engine 10. Thus, the dents 30 are formed in the outer coolant passage 23B, so that it is possible to improve cooling performance of the fastening tools fixed to the fastening holes 20. Further, it is possible to avoid a situation that a fastening force at a connection portion of the cylinder head 1 and the exhaust pipe (including a pipe member for connecting a catalyst device, the turbocharger and the like) lowers due to heat.

(6) As illustrated in FIG. 5(B), in the outer coolant passage 23B, the guides 31 which guide the engine coolant circulation direction are formed along the two bosses 19 (or the outer circumferences of the fastening holes 20). Each guide 31 functions to smooth a flow of an engine coolant which is likely to be blocked by the dents 30. For example, the engine coolant flowing from the cylinder #1 side comes into contact with the surface of one guide 31, is guided toward the two bosses 19 (projecting portion 35), then comes into contact with the surface of the other guide 31 and flows out toward the cylinder #4 side. Thus, the guides 31 are formed to meet the dents 30 and the projecting portion 35 of the outer coolant passage 23B, so that it is possible to enhance cooling efficiency of the bosses 19 and the outer circumferences of the fastening holes 20.

(7) Outside the outer coolant passage 23B, the coolant ribs 32 bulging from the outer surface of the cylinder head 1 are formed. Consequently, it is possible to increase the surface area of the side surface 14C of the protruding portion 14 and improve heat radiation performance. Further, heat of the engine coolant circulating inside the outer coolant passage 23B is dissipated to the outside of the engine 10 via the coolant ribs 32. Consequently, it is possible to suppress a rise in the temperature of the cooling system and improve cooling performance of the outer coolant passage 23B.

(8) Heat environment (e.g. heat transfer amounts from the cylinder block 2, the turbocharger and the exhaust catalyst device) differs between the upper side and the lower side of the cylinder head 1, and therefore cooling capability which the water jacket 4 needs to satisfy slightly differs. Meanwhile, the cylinder head 1 includes the upper water jacket 4A and the lower water jacket 4B as the water jacket 4 which cools the manifold (multi-branched) exhaust port 6. Thus, coolant passages of the two upper and lower systems are formed, so that it is possible to reduce each flow passage sectional area and increase a flow velocity of a coolant while securing the total flow passage sectional area. Consequently, it is possible to improve cooling efficiency of the surroundings of the exhaust port 6 built in the cylinder head 1. Further, the water jacket 4 are separately provided to the upper side and the lower side of the cylinder head 1, respectively, so that it is possible to provide cooling capability which is suitable to each coolant passage, and improve cooling performance of the engine 10 and control performance for the cooling performance.

Further, one water jacket 4 protrudes to the outside compared to the other water jacket 4, so that it is possible to vary flow rates and flow velocities of the upper and lower water jackets 4A and 4B, and set cooling capability which matches each portion and improve cooling performance of the engine 10 and control performance for the cooling performance. For example, in case of the engine 10 whose bottom surface is more readily heated than the top surface side, it is possible to make the lower water jacket 4B larger than the upper water jacket 4A to increase cooling capability at the bottom surface side, and improve cooling performance and cooling efficiency of the cylinder head 1. By contrast with this, in case of the engine 10 whose top surface side is more readily heated than the bottom surface side, it is possible to make the upper water jacket 4A larger than the lower water jacket 4B, and improve cooling performance and cooling efficiency of the cylinder head 1.

(9) In the cylinder head 1, the lower water jacket 4B is formed in a shape protruding toward the outside of the engine 10 compared to the upper water jacket 4A, so that it is possible to insulate heat transfer between the cylinder head 1 side (upper side) and the cylinder block 2 (lower side) and improve cooling performance and cooling efficiency of the cylinder head 1. Further, the lower water jacket 4B close to a fire contact surface protrudes toward the outside of the engine 10 compared to the upper water jacket 4A, so that it is possible to efficiently insulate heat transfer from the cylinder block side and improve a heat insulation effect with respect to the cylinder head 1.

Particularly, a position at which the lower water jacket 4B protrudes is the center portion facing the merged passage 6D of the exhaust port 6, so that it is possible to enhance cooling efficiency of the flange 15 and avoid a situation that the fastening force lowers due to heat.

(10) Further, the entire shape of these water jackets 4A and 4B is a half-disk shape encircled by the exhaust port 6 and the cylinder bank connected to the outer cylinders (the cylinder #1 and the cylinder #4), so that it is possible to make dimensions in the upper and lower directions compact, and save a space of the water jackets 4A and 4B while enhancing cooling efficiency of the entire exhaust port 6.

(11) As illustrated in FIG. 6(A), in the cylinder head 1, the two fastening holes 20 on whose back side the upper water jacket 4A is not disposed are connected by the upper fastening area 15B on whose back side the upper water jacket 4A is not disposed likewise. Meanwhile, the two fastening holes 20 on whose back side the lower water jacket 4B is disposed is connected by the lower fastening area 15C on whose back side the lower water jacket 4B is disposed. Such a layout can make uniform a heat distribution in the upper fastening area 15B and the lower fastening area 15C, respectively, and maintain the fastening force of the fastening surface 15A.

(12) Further, an air-cooling structure such as the thin portions 21 and the heat radiation ribs 22 is applied to the center fastening area 15D sandwiched by these upper fastening area 15B and lower fastening area 15C, so that it is possible to secure stable cooling performance, maintain a moderate temperature gradient corresponding to a temperature difference between the upper fastening area 15B and the lower fastening area 15C, and maintain the fastening force of the fastening surface 15A.

5. Modified Example

Irrespectively of the above-described embodiment, the embodiment can be variously modified and carried out without departing from a spirit of the embodiment. Each component in the present embodiment can be selected if necessary or may be optionally combined.

For example, in the above-described embodiment, upper and lower water jackets 4A and 4B of two layers are formed inside a protruding portion 14. However, the number of layers of the water jacket 4 may be one or three or more, i.e., plural. By at least separately forming the water jacket 4 including arbitrary layers for an outer coolant passage 23 and an inner coolant passage 24, it is possible to flexibly change each flow passage sectional area, provide cooling capability which takes heat radiation performance into account and improve cooling efficiency of the cylinder head 1.

Further, in the above-described embodiment, water jackets 23 and 24 of two inner and outer systems are formed inside the protruding portion 14. However, the number of systems of the water jacket 4 may be one or three or more. By forming at least the upper and lower water jackets 4A and 4B of the two systems, it is possible to flexibly change each flow passage section area, provide cooling capability which takes heat radiation performance into account and improve cooling efficiency of the cylinder head 1.

Further, in the above-described embodiment, the outer coolant passage 23 and the inner coolant passage 24 are both disposed in semicircular arc shapes when seen from a top view of an engine 10. However, a specific arrangement shape is not limited to these semicircular arc shapes. For example, an optimal arrangement shape may be set by taking into account a degree that an engine coolant easily flows, a heat distribution of the cylinder head 1, a heat dissipation amount (air-cooling efficiency) from an outer surface of the protruding portion 14, and a heat receiving amount from a cylinder block 2 side.

Further, in the above-described embodiment, a flange 15 is disposed in a center of a cylinder bank direction L. However, the position of the flange 15 is not limited to this. For example, the position of the flange 15 may be shifted in one of left and right directions in FIG. 4. Further, a specific shape of the flange 15 can also be arbitrarily set. Bosses 19 may not be formed at four corners of a fastening surface 15A, and the number of bosses 19 may be three. Further, a positional relationship between the bosses 19 and the water jackets 4A and 4B inside a cylinder head 1 is not limited to the above.

The above-described cylinder head 1 is also applicable to a multi-cylinder engine (e.g. an inline-three cylinder engine or a V6 cylinder engine) other than the inline-four cylinder engine 10. Further, the cylinder head 1 may also be applicable to an engine in which a suction valve hole 11 and an exhaust valve hole 12 are provided one by one to one cylinder 3 (such an engine is a non-multi-valve engine).

REFERENCE SIGNS LIST

2 CYLINDER BLOCK
4 WATER JACKET

4A UPPER WATER JACKET (UPPER COOLANT PASSAGE)
4B LOWER WATER JACKET (LOWER COOLANT PASSAGE)
5 SUCTION PORT
6 EXHAUST PORT
14 PROTRUDING PORTION
14A TOP SURFACE
14B BOTTOM SURFACE
14C SIDE SURFACE (OUTER SURFACE)
15 FLANGE
15A FASTENING SURFACE
16 BIFURCATED PORTION
17 SECOND BIFURCATED PORTION
20 FASTENING HOLE (SCREW HOLE)
23 OUTER COOLANT PASSAGE
24 INNER COOLANT PASSAGE
27 NARROWED PORTION
28 CONNECTION COOLANT PASSAGE
28 ISLAND
29 DENT
30 GUIDE
32 COOLANT RIB

The invention claimed is:

1. A cylinder head of an engine, the engine having a plurality of cylinders aligned in a longitudinal direction of the engine, the cylinder head comprising:

a side wall extending along the longitudinal direction of the engine;

a manifold protruding from the side wall in a direction away from the plurality of cylinders, the manifold including a merged passage at a downstream side thereof, a plurality of large passages bifurcating from the merged passage, a plurality of middle passages bifurcating from the large passages, and a plurality of small passages bifurcating from the middle passages;

a coolant inlet formed in one end of the cylinder head with respect to the longitudinal direction of the engine;

a coolant outlet formed in another end of the cylinder head with respect to the longitudinal direction of the engine;

an outer coolant passage in which an engine coolant circulates, the outer coolant passage being defined inside the manifold and being semicircular in shape, such that the outer coolant passage extends along an outer periphery of the manifold from the coolant inlet to the coolant outlet formed in the cylinder head;

an inner coolant passage in which the engine coolant circulates, the inner coolant passage being defined inside the manifold and being semicircular in shape, the inner coolant passage branches from an upstream portion of the outer coolant passage and rejoins the outer coolant passage at a downstream portion of the outer coolant passage with respect to a flowing direction of the engine coolant; and a plurality of connection coolant passages that connects the outer coolant passage and the inner coolant passage, wherein:

the outer coolant passage is disposed along a first part of the manifold connected to an outer cylinder among the plurality of cylinders in plan view;

the inner coolant passage is disposed along a second part of the manifold connected to an inner cylinder among the plurality of cylinders and closer to the plurality of cylinders compared to the outer coolant passage in plan view;

the manifold includes a first bifurcated portion from which the middle passages bifurcate and a second bifurcated portion from which the large passages bifurcate; and the connection coolant passages are disposed at positions overlapping the first bifurcated portion and the second bifurcated portion in plan view.

2. The cylinder head according to claim 1, wherein the outer coolant passage and the inner coolant passage are disposed forming a pair that sandwiches an exhaust port in the manifold from above and below.

3. The cylinder head of the engine according to claim 1, wherein the outer coolant passage includes a dent at a position meeting a screw hole, the dent having a shape dented toward an inside of the cylinder head and the screw hole being bored in a fastening surface between the cylinder head and an exhaust pipe.

4. The cylinder head of the engine according to claim 3, wherein the outer coolant passage includes a guide that guides a circulation direction of the coolant along an outer circumference of the screw hole.

5. The cylinder head of the engine according to claim 1, further comprising:

a coolant rib having a swelled portion that extends continuously in a string shape and is disposed outside the outer coolant passage, the swelled portion protruding outward from the outer surface of the cylinder head.

6. The cylinder head of the engine according to claim 1, further comprising:

an upper coolant passage in which the engine coolant circulates and that is planarly disposed along a top surface of the manifold; and a lower coolant passage in which the engine coolant circulates and that is planarly disposed along a bottom surface of the manifold, wherein one of the upper coolant passage and the lower coolant passage protrudes outward from the side wall in a direction further away from the side wall compared to another one of the upper coolant passage and the lower coolant passage.

7. The cylinder head of the engine according to claim 6, wherein the lower coolant passage extends outside in the direction further away from the side wall compared to the upper coolant passage.

8. The cylinder head of the engine according to claim 7, wherein the lower coolant passage is partially defined by a flange extending outside from the side wall and the flange forms a fastening surface with respect to an exhaust pipe connected to a downstream side of the manifold.

9. The cylinder head of the engine according to claim 6, wherein the upper coolant passage is defined by the first part of the manifold and a cylinder bank of the engine, and the lower coolant passage extends further outside from the side wall compared to the upper coolant passage.

10. The cylinder head of the engine according to claim 7, wherein the upper coolant is defined by the first part of the manifold and a cylinder bank of the engine, and the lower coolant passage extends further outside from the side wall compared to the upper coolant passage.

11. The cylinder head of the engine according to claim 8, wherein the upper coolant passage is defined by the first part of the manifold and a cylinder bank of the engine, and the lower coolant passage extends further outside from the side wall compared to the upper coolant passage.

* * * * *